United States Patent [19]

Brown et al.

[11] Patent Number: 5,050,467

[45] Date of Patent: Sep. 24, 1991

[54] WRENCH SOCKET RETAINER

[76] Inventors: Thomas L. Brown, 6160 S. Quail Hwy., Littleton, Colo. 80127; Andrew F. Roe, 5780 S. Delaware, Littleton, Colo. 80120

[21] Appl. No.: 562,939

[22] Filed: Aug. 6, 1990

[51] Int. Cl.[5] ..... B25B 21/02

[52] U.S. Cl. ..... 81/466; 81/177.85; 81/54; 403/325

[58] Field of Search ..... 81/177.85, 177.2, 54, 81/52, 463–466; 403/325

[56] References Cited

U.S. PATENT DOCUMENTS 3,172,675 3/1965 Gonzalez ..... 403/325 X 4,141,261 2/1979 Tummel .

4,399,722 8/1983 Sardo, Jr. ..... 81/177.85 X

*Primary Examiner*—D. S. Meislin

[57] ABSTRACT

A detent mechanism for releasably retaining a wrench socket on the rotary drive member of an air impact wrench. A push rod is provided within the wrench body to normally support a ball detent in a locking position projecting from a side surface of a drive member plug portion that is adapted to extend into a wrench socket. Manual push motion on a rear end of the rod causes a pocket in the side face of the push rod to register with the ball detent for enabling the detent to retract into the plug portion of the drive member.

1 Claim, 1 Drawing Sheet

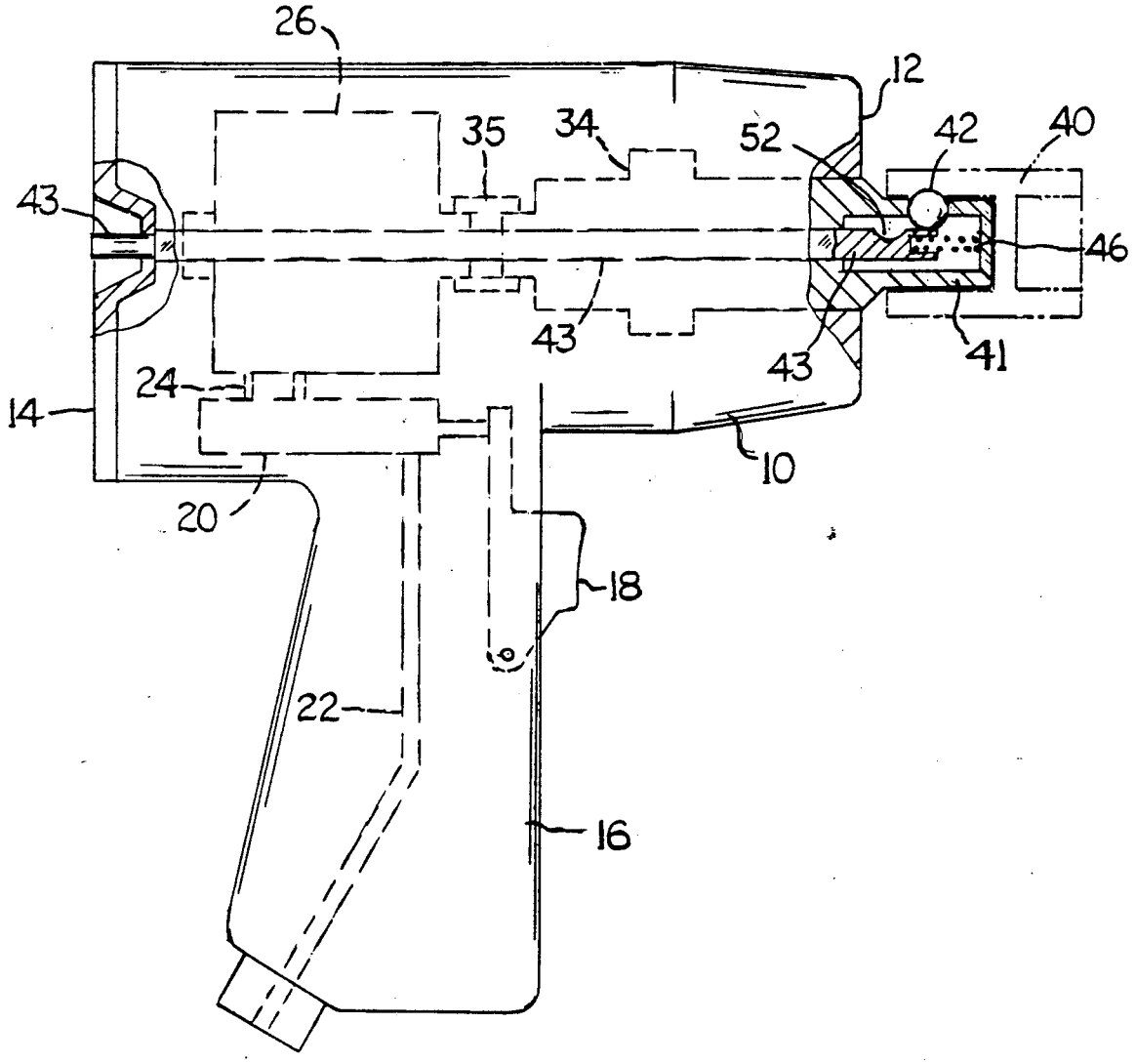
26
12
35
34
52
42
40
43
46
43
43
41
24
14
10
20
18
22
16

WRENCH SOCKET RETAINER

BACKGROUND AND SUMMARY OF THE INVENTION

This invention relates to air-operated wrenches, used with sockets for turning nuts and bolts. Such wrenches are sometimes referred to as air impact wrenches.

These wrenches commonly comprise a rotary motor operated by compressed air to impart a rotary motion to a socket drive member located on the front end of the motor shaft. Differently sized sockets are selectively attached to the socket drive member.

The present invention concerns a detent mechanism for releaseably retaining any selected socket on the socket drive member. The detent mechanism preferably includes a ball-shaped detent element projecting laterally through an opening in the socket drive member for entry into a spherically-shaped recess in an associated socket. A manually-operable push rod extends axially through the motor and socket drive member to releaseably support the detent element against retractive movement in the socket drive member. Manual pressure on the rear end of the push rod brings a pocket on the side surface of the push rod into registry with the ball detent, thereby enabling the detent to be retracted into the drive socket member so that the associated socket can be manually removed from the socket drive member.

THE DRAWINGS

The single FIGURE shows an air impact wrench equipped with a detent mechanism of the present invention.

DESCRIPTION OF A PREFERRED EMBODIMENT OF THE INVENTION

The drawing shows some features of a commercially available wrench operated by compressed air. The wrench comprises a housing 10 having a front face 12 and a rear face 14. The housing includes a handle 16 that pivotably supports a finger-operated trigger 18 connected to a spool valve 20 for controlling the flow of compressed air through passages 22 and 24 to a rotary vane motor 26.

Motor 26 includes a hollow drive shaft that is attached to a rotary anvil member 34 via a coupling 35. The right end of anvil member 34 is configured as a square cross-sectioned plug 41 adapted to fit into a wrench socket 40.

Extending axially through motor 26 and anvil member 34 is a push rod 43. The push rod may be keyed to member 34 by forming the rod with a square cross section mated to a square hole in member 34. A spring 46 normally positions rod 43 in its illustrated position wherein a flat on the rod supports a ball detent 42 in a position projecting beyond the outer side face of plug 41. The ball detent extends into a spherical pocket in wrench socket 40 to retain the socket on the plug.

Manual pressure on the rear end of rod 43 causes the rod to move to the right, such that a spherical recess 52 in the side face of the rod registers with ball detent 42. The wrench socket can be pulled off of plug 41 because ball detent 42 can shift into recess 52 by cam action.

The ball detent and push rod combination represents a relatively easy mechanism to operate between its two positions.

What is claimed is:

1. A rotary torque wrench comprising a housing having a front face and a rear face, a rotary air motor located within the housing near the housing rear face, a rotary socket-drive anvil element (34) axially aligned with the motor between the motor and the housing front face, said anvil element having an external plug with flat side faces thereon for transmission of a rotary drive force to a wrench socket insertable onto the plug, said anvil having a square hole extending axially therethrough in alignment with the motor axis, a square cross-sectioned push rod (43) extending axially through the motor and the square hole in the anvil so that the push rod rotates with the anvil, the square cross-sectioned push rod being slidably keyed to the square hole in the anvil so that the push rod can be moved axially, said push rod having an end section thereof extending within the external plug, a ball-shaped detent element (42) floatably mounted in an opening in a side face of the plug for transverse projection into a recess in a wrench socket; said square cross-sectioned push rod having a flat side-facing support surface engageable with said detent element to normally support said detent element against retraction into the plug; said push rod having a spherical pocket in its side-facing support surface adapted to register with the detent element when said push rod is moved axially forwardly, said push rod having a front end within the external plug, and a coil spring located with the external plug in pressure engagement with the front end of the push rod for normally positioning the rod so that the detent element is supported against retraction into the plug, said push rod having a rear end extending through and beyond the housing rear face whereby an axial pushing force on the rod rear end moves the rod to a position wherein the spherical pocket is in registry with the ball-shaped detent element.

* * * * *